US006635357B2

(12) United States Patent
Moxson et al.

(10) Patent No.: US 6,635,357 B2
(45) Date of Patent: Oct. 21, 2003

(54) BULLETPROOF LIGHTWEIGHT METAL MATRIX MACROCOMPOSITES WITH CONTROLLED STRUCTURE AND MANUFACTURE THE SAME

(76) Inventors: Vladimir S. Moxson, 2525 Deer Hollow, Hudson, OH (US) 44236; Eugene Ivanov, 3198 Windsor Pl., Grove City, OH (US) 43123

( * ) Notice: Subject to any disclaimer, the term of this patent is extended or adjusted under 35 U.S.C. 154(b) by 0 days.

(21) Appl. No.: 10/084,867

(22) Filed: Feb. 28, 2002

(65) Prior Publication Data

US 2003/0161750 A1 Aug. 28, 2003

(51) Int. Cl.[7] ..... B22F 7/02; B22F 7/00; F41H 5/04

(52) U.S. Cl. ..... 428/548; 428/551; 428/553; 428/567; 428/568; 89/36.02; 89/36.11; 419/5; 419/10; 419/27; 419/53; 419/54

(58) Field of Search ..... 419/5, 10, 27, 419/53, 54; 75/228; 89/36.01, 36.02, 36.11; 428/548, 551, 553, 567, 568

(56) References Cited

U.S. PATENT DOCUMENTS

| | | | | |
|---|---|---|---|---|
| 3,645,803 A | | 2/1972 | Huber et al. | 148/127 |
| 4,200,677 A | | 4/1980 | Bottini et al. | 442/254 |
| 4,598,647 A | | 7/1986 | Biedess | 109/77 |
| 4,834,938 A | | 5/1989 | Pyzik et al. | 419/6 |
| 5,238,883 A | | 8/1993 | Newkirk et al. | 501/87 |
| 5,277,933 A | | 1/1994 | Claar et al. | 427/248.1 |
| 5,335,712 A | | 8/1994 | Corbett et al. | 164/97 |
| 5,340,655 A | | 8/1994 | Creber et al. | 428/446 |
| 5,361,678 A | * | 11/1994 | Roopchand et al. | 89/36.02 |

(List continued on next page.)

FOREIGN PATENT DOCUMENTS

| | | | | |
|---|---|---|---|---|
| DE | 19938308 | * | 3/2000 | C22C/29/06 |
| DE | 19917175 | * | 10/2000 | B22D/19/00 |
| DE | 10013378 | * | 10/2001 | C04B/41/88 |

(List continued on next page.)

OTHER PUBLICATIONS

Fukunaga H. and Pan J. New processing of whisker–reinforced metal matrix composites, *Int. Conf. Process. Mater. Prop., 2nd*, 2000, *pp.* 149–154.

Bunk W.G.J. Metal matrix composites: a survey, *NATO ASI Ser., Ser. 3 (1998), 59(Advanced Light Alloys and Composites), pp. 53–64.*

Carreno–Morelli E., et al., Processing and characterization od AL–based MMC produced by gas pressure infiltration, Mater. Science Eng., A (1998), A251 (1–2), pp. 48–57.

(List continued on next page.)

*Primary Examiner*—Daniel J. Jenkins

(57) ABSTRACT

The lightweight bulletproof metal matrix macrocomposites (MMMC) contain (a) 10–99 vol. % of permeable skeleton structure of titanium, titanium aluminide, Ti-based alloys, and/or mixtures thereof infiltrated with low-melting metal selected from Al, Mg, or their alloys, and (b) 1–90 vol. % of ceramic and/or metal inserts positioned within said skeleton, whereby a normal projection area of each of said inserts is equal to or larger than the cross-section area of a bullet or a projectile body. The MMMC are manufactured as flat or solid-shaped, double-layer, or multi-layer articles containing the same inserts or different inserts in each layer, whereby insert projections of each layer cover spaces between inserts of the underlying layer. The infiltrated metal contains 1–70 wt. % of Al and Mg in the balance, optionally, alloyed with Ti, Si, Zr, Nb, V, as well as with 0–3 wt. % of $TiB_2$, SiC, or $Si_3N_4$ sub-micron powders, to promote infiltrating and wetting by Al-containing alloys. The manufacture includes (a) forming the permeable metal powder and inserts into the skeleton-structured preform by positioning inserts in the powder followed by loose sintering in vacuum to provide the average porosity of 20–70%, (b) heating and infiltrating the porous preform with molten infiltrating metal for 10–40 min at 450–750° C., (c) hot isostatic pressing of the infiltrated composite, and (d) re-sintering or diffusion annealing.

16 Claims, 5 Drawing Sheets

U.S. PATENT DOCUMENTS

| | | | | | |
|---|---|---|---|---|---|
| 5,370,035 | A | | 12/1994 | Madden, Jr. | 89/36.08 |
| 5,371,049 | A | * | 12/1994 | Moffett et al. | 501/89 |
| 5,438,908 | A | | 8/1995 | Madden, Jr. | 89/36.08 |
| 5,443,917 | A | * | 8/1995 | Tarry | 428/545 |
| 5,448,938 | A | | 9/1995 | Fernandez et al. | 89/36.02 |
| 5,501,263 | A | | 3/1996 | Dwivedi et al. | 164/97 |
| 5,531,260 | A | | 7/1996 | Burke | 164/97 |
| 5,549,151 | A | | 8/1996 | Yang | 164/97 |
| 5,585,190 | A | | 12/1996 | Newkirk et al. | 428/469 |
| 5,614,308 | A | | 3/1997 | Claar | 428/312.6 |
| 5,618,635 | A | | 4/1997 | Newkirk et al. | 428/614 |
| 5,619,007 | A | | 4/1997 | Mena et al. | 89/36.09 |
| 5,620,804 | A | | 4/1997 | Kennedy et al. | 428/609 |
| 5,638,886 | A | | 6/1997 | Aghajanian et al. | 164/97 |
| 5,654,246 | A | | 8/1997 | Newkirk et al. | 501/8 |
| 5,677,029 | A | | 10/1997 | Prevorsec et al. | 428/113 |
| 5,824,940 | A | * | 10/1998 | Chediak et al. | 89/36.05 |
| 5,834,115 | A | | 11/1998 | Weeks et al. | 428/37 |
| 5,856,025 | A | * | 1/1999 | White et al. | 428/614 |
| 5,985,464 | A | * | 11/1999 | Schmitt et al. | 428/457 |
| 6,022,505 | A | * | 2/2000 | Rauscher et al. | 264/643 |
| 6,034,004 | A | * | 3/2000 | Fels et al. | 442/135 |
| 6,051,045 | A | * | 4/2000 | Narula et al. | 75/233 |
| 6,161,462 | A | * | 12/2000 | Michaelson | 89/36.01 |
| 6,200,526 | B1 | * | 3/2001 | Fox et al. | 419/47 |
| 6,271,162 | B1 | * | 8/2001 | Haug et al. | 501/87 |

FOREIGN PATENT DOCUMENTS

| | | | | |
|---|---|---|---|---|
| DE | 10025489 | * | 1/2002 | B22D/17/20 |
| EP | 245192 | * | 11/1987 | C04B/35/65 |
| EP | 323945 | * | 1/1989 | C04B/41/88 |
| EP | 333629 | * | 9/1989 | C04B/41/88 |
| EP | 346771 | * | 12/1989 | C22C/1/10 |
| EP | 407331 | * | 1/1991 | C04B/35/65 |
| EP | 409764 | * | 1/1991 | C04B/35/65 |
| EP | 427658 | | 5/1991 | C22C/1/09 |
| GB | 2255351 | * | 10/1992 | C23C/2/00 |
| GB | 2309924 | * | 8/1997 | B22D/19/00 |
| JP | 01279721 | * | 11/1989 | C22C/1/09 |
| JP | 02254128 | * | 10/1990 | C22C/1/09 |
| JP | 03002338 | * | 1/1991 | C22C/1/09 |
| JP | 10237566 | * | 9/1998 | C22C/1/09 |
| JP | 11172348 | * | 6/1999 | C22C/1/10 |
| JP | 11200030 | * | 7/1999 | C23B/14/34 |
| JP | 11228262 | * | 8/1999 | C04B/41/88 |
| JP | 2000017351 | * | 1/2000 | C22C/1/10 |
| WO | WO 9117129 | | 11/1991 | C04B/35/65 |
| WO | WO 9117275 | | 11/1991 | C22C/1/09 |
| WO | WO 9118122 | | 11/1991 | C22C/1/10 |
| WO | WO 9214687 | | 9/1992 | C04B/41/51 |
| WO | WO 9400660 | | 1/1994 | C22C/1/10 |
| WO | WO 9515919 | | 6/1995 | C01B/31/00 |
| WO | WO 9741368 | | 11/1997 | F16D/69/02 |
| WO | WO 9931958 | | 7/1999 | B29D/19/00 |
| WO | WO 9932418 | | 7/1999 | C04B/41/00 |
| WO | WO 9932676 | | 7/1999 | C22C/1/00 |
| WO | WO 9932677 | | 7/1999 | |
| WO | WO 9932678 | | 7/1999 | C22C/1/10 |
| WO | WO 200054852 | | 9/2000 | A63B/53/04 |
| WO | WO 2001087520 | | 11/2001 | B22D/19/08 |

OTHER PUBLICATIONS

Degischer H.P. Innovative light metals: metal matrix composites and foamed Al, *Mater. Des., 1998, 18* (*4/6*), *pp. 221–226*.

Bouix J., et al. Interface tailoring in carbon fiber–reinforced metal matrix composites, *J. Phys., IV* (*1997*), *7* (*C6, Surfaces et Interfaces des Materiaux Advances*), *pp. c6/191–C6/205*.

Kainer K.U. Metal matrix composites: potentials, materials, and developmental trend, *VDI–Ber.* (*1996*), *1276* (*Bearbeitung Neuer Werkstoffe*), *pp. 329–343*.

Kainer K.U. Aluminum and magnesium–based metal matrix composites, *Kovine, Zlitine, Technol. 1996, 30*(*6*), *pp. 509–516*.

Choh T., et al., Fabrication of metal matrix composites by spontaneous infiltration and subsequent in situ reaction processes, *Mater. Sci. Forum, 1996, 217–222* (*Aluminum Alloys, Pt. 1*), *pp. 353–358*.

Park B.G., et al., Fracture behavior and toughness of an aluminum 6061 metal matrix composites, *J. Australas Cera. Soc., 1994, 30*(*1/2*), *pp. 41–47*.

Schulte K. Actual developments in the field of composite materials, *VDI–Ber, 1992, 965.1* (*Verbundwerkstoffe and Werkstoffverbunde, Teil 1*), *pp. 1–24*.

Wong C.R., et al. Damping studies of ceramic reinforced aluminum, *ASTM Spec. Tech. Publ., 1992, STP 1169* (*MD3: mechanics of Material Damping*), *pp. 76–93*.

Hogg P.J. and Ahmadnia A. Impact properties of metal–composite laminates, *ICCM ECCM, 6th* Int. Conf. Compos. Mater., 1987, v. 3, pp. 3.46–3.56.

* cited by examiner a b c

BULLETPROOF LIGHTWEIGHT METAL MATRIX MACROCOMPOSITES WITH CONTROLLED STRUCTURE AND MANUFACTURE THE SAME

FIELD OF INVENTION

The present invention relates to lightweight metal matrix macrocomposites (MMMC) manufactured by low-melted liquid alloy infiltrating a sintered metal powdered preform with ceramic inserts distributed within. More particularly, the invention is directed to MMMC having controlled bulletproof structure and methods of the manufacture the same.

BACKGROUND OF THE INVENTION

Composite materials providing protection against the impact of bullets or small-size projectiles such a grenade splinters have become standard materials for military, police, and other fields requiring security in the line of duty. Most conventional bulletproof composites are made as clothing (vests) manufactured from carbonized polymeric and ceramic fibers, for example, in the U.S. Pat. Nos. 5,448,938; 5,370,035 and 6,034,004. Though such materials are well known in the industry, they are not enough protection in many situations, e.g., against short distance impact.

There are also bulletproof structures such as doorframes as described in the U.S. Pat. No. 4,598,647 using solid materials having adequate strength to prevent penetration of a bullet, but such materials and structures are usually too complex and too heavy to be suitable in airplanes and vehicles. Solutions to this problem are very expensive and do not offer the required reliability.

Therefore, it would be desirable to use high strength lightweight metal composite materials for advantageous substitution of conventional bulletproof structures in specific applications such as airplane door frames and seat shields, or shields for the occupants of a helicopter, as well as personal protection systems.

Metal matrix composites manufactured by methods of powder metallurgy, especially by infiltrating with a molten metal, are attractive materials for structural applications not only due to their excellent properties such as stiffness, light weight, high abrasion and oxidation resistance, but mainly due to the opportunity to compose materials containing combinations of metals and ceramics that can be difficult or cost prohibitive when produced by methods of conventional metallurgy and machining.

All known infiltrated metal matrix composites can be classified in one of two big groups: (1) microcomposites containing infiltrated solid phases in the form of fine powders or fibers, and (2) macrocomposites containing whiskers, bars, or spheres having at least one dimension that is significantly larger than a cross-section of the infiltrated metal layer between such solid components.

The infiltrated microcomposites are usually brittle and exhibit insufficient flexure or fatigue strength, and low fracture toughness, which is why these materials are not used as bullet- or projectile-protective armor.

Theoretically, metal matrix macrocomposites (MMMC) can be used for these purposes, but a review of conventional MMMC showed that they all are not suitable as effective bulletproof materials because they are designed and manufactured to resist only tensile or compressive loads.

For example, a MMMC described in the U.S. Pat. Nos. 5,333,712 and 5,856,025 consist of ceramic platelets, spheres, pellets, filaments, and whiskers infiltrated with molten aluminum or Al-Mg alloy. The ceramic inserts in such composites are randomly situated in the light metal matrix, therefore, the material has irregular structure, unable to resist impact from a frontal direction. Another disadvantage of these composite structures is the lack of strength of aluminum or Al-Mg interlayers between ceramic inserts. A significant difference in mechanical properties between hard ceramic fillers and soft metal interlayers results in a low impact strength and easy crack propagation of the composite upon the whole.

Many structural modifications and methods have been proposed during the last three decades in order to increase the strength of macrocomposites: from forming barrier oxide or nitride layers (as in U.S. Pat. No. 5,501,263), to reinforcing soft interlayers with ceramic fibers (as in JP 10237566, 1998) or titanium diboride particles (as in U.S. Pat. No. 4,834,938). But, an incompatibility of soft metal matrix with hard fillers and the structural irregularity are still remained as the main drawbacks of such macrocomposites. Not one of these structures can be deemed as an efficient energy absorbing system, because crack propagation in any direction is statistically unpredictable.

The use of sacrificial composite bed is disclosed in WO 9932418, 1999 to decrease thermal stress and to eliminate cracking on the edge of the macrocomposite plate. This solution improves the dynamic strength, but also significantly increases the weight of the composite manufactured by infiltrating alumina granules with Al-5% Mg alloy melt.

Finally, aluminum and magnesium as soft infiltrating metal were substituted by titanium, zirconium, or hafnium as disclosed in the U.S. Pat. No. 5,614,308. In this case, light weight and low production cost were sacrificed in order to gain strength, and such macrocomposites could not be considered as promising materials.

All other lightweight MMMC and methods of making them known in the prior art have the same drawbacks: (a) irregular structures with statistically-undefined positions of hard inserts and soft interlayers, (b) low reproduction of mechanical properties, (c) insufficient ability to absorb impact energy and to stop crack propagation after bullet penetration through the surface layer of the protective materials, and (d) high production cost or excessive weight if the strength is provided.

OBJECTIVES OF THE INVENTION

The object of the invention is to design and manufacture the lightweight macrocomposite structure, able to absorb the impact energy, and to stop crack propagation after bullet or. splinter penetration through the surface of the material.

A hard, energy-absorbing, lightweight, metal matrix compatible to hard ceramic inserts must be manufactured using low-melted aluminum-magnesium alloys.

Another objective of the present invention is to design and manufacture the lightweight macrocomposite having controlled regular structure, which provides high reproduction of mechanical properties.

It is yet a further objective to provide a cost-effective manufacture of bulletproof lightweight macrocomposites.

The nature, utility, and further features of this invention will be more apparent from the following detailed description with respect to preferred embodiments of the invented technology.

SUMMARY OF THE INVENTION

The invention relates to lightweight MMMC manufactured by infiltrating solid metal powder and ceramic inserts with low-melted liquid metal or alloy. While the use of ceramic inserts and Al-Mg infiltrates has previously been contemplated in the MMMC production as mentioned above, problems related to insufficient impact strength, material reliability, compatibility of metal matrix and ceramic inserts, elimination of crack propagation, and cost cutting have not been solved.

The invention overcomes these problems by:

(1) The manufacture of MMMC containing a permeable skeleton structure of titanium, titanium aluminides ($Ti_3Al$, TiAl, and $TiAl_3$), or other Ti-based alloys infiltrated with aluminum, magnesium, or their alloys and 1–90 vol. % of ceramic or metal inserts positioned within said skeleton, whereby a normal projection area of each of said inserts is equal to or larger than the cross-section of a bullet or a projectile body;

(2) Manufacture, including the steps of (a) forming the permeable metal powder and inserts into the skeleton-structured preform by positioning inserts in the powder followed by loose sintering to provide the average porosity of 20–70%, (b) heating and infiltrating the resulting preform at 450–750° C., (c) hot isostatic pressing of the infiltrated composite to heal porosity and transform it into the textured microstructure strengthened by intermetallic phases, and (d) re-sintering or diffusion annealing of the MMMC;

(3) Positioning inserts in metal powder in a predetermined geometrical pattern, filling the gaps between inserts with a metal powder, placing a new layer of inserts onto the first layer so that the second layer of inserts is placed over the spaces between the first layer inserts. This procedure may be repeated until the desired number of layers is structured.

In another aspect of the invention, a technology is provided to manufacture lightweight, bulletproof MMMC having regular energy-absorbing structure and statistically reproductive mechanical properties.

In essence, the core of the invention is to control the macrostructure of the MMMC using (a) a regular, customized pattern of positioning ceramic inserts, thus eliminating the penetration of a bullet within the entire frontal area of the composite, (b) formation of a hard metal matrix compatible with ceramic inserts and difficult for crack propagation, (c) loose sintering powders of such strong alloys as Ti-6Al-4V or TiAl together with ceramic inserts followed by the infiltration of such skeleton by Al-Mg melt, (d) dispersion strengthening of the metal matrix by sub-micron ceramic and intermetallic particles, and (e) transformation of the infiltrated metal matrix into the textured microstructure by hot isostatic pressing followed by re-sintering.

The invented technology allows the control of the macrostructure and mechanical properties of the composite materials by changing matrix composition, shape and position of inserts, number of layers, parameters of deformation, infiltration, and heat treatment, etc. The technology is suitable for the manufacture of flat or shaped metal matrix macrocomposites having improved ductility and impact energy absorption such as lightweight bulletproof plates and sheets for airplane, helicopter, and automotive applications.

DETAILED DESCRIPTION AND PREFERRED EMBODIMENTS OF THE INVENTION

As discussed, the present invention relates generally to the manufacture of lightweight metal matrix macrocomposites containing ceramic inserts as main components to block a bullet penetration. The compatibility of metal matrix and ceramic inserts plays a very important role in such composites.

All methods, known in the industry and mentioned in References, used direct infiltration of ceramic inserts mixture or ceramic sintered body. As a result, they obtained a soft casting metal matrix mechanically incompatible to the ceramics. Therefore, MMMC containing incompatible components often have macro- and micro-cracks even before the use of these materials for bulletproof purposes.

In order to provide better compatibility in such mechanical properties as impact strength, ductility, and thermal expansion, the metal matrix of our MMMC is manufactured by the loose sintering of metal powders to obtain a strong skeletal structure infiltrated with low-melted lightweight alloys. The C.P. titanium powder, Ti-6Al-4V and powdered titanium aluminide alloys are used for loose sintered matrix. The sintered and infiltrated matrix has mechanical properties much closer to the properties of ceramics than the cast matrix used in known methods. The combination of hard ceramic, hard sintered Ti-based skeleton, and soft infiltrated Al-Mg interlayers provides effective energy absorption of the MMMC structure.

Infiltrated alloys used in the invented technology contain up to 70 wt. % of aluminum, 1–4 wt. % of Ti, Si, Zr, Nb, or V, with magnesium in the balance. We found that these alloys exhibit a perfect wettability of Ti-based sintered skeleton. The enhanced wettability provides a complete saturation of all open pore channels by the infiltrated melt, independent of the pore size. Besides, said additives generate dispersed intermetallics such as silicides and aluminides after solidification of the infiltrated alloy. The size of these intermetallic intrusions is regulated by subsequent sintering and diffusion annealing, therefore, the formation of such dispersed hard micro-particles is one way, among others, to control the microstructure and mechanical properties of the composite material.

The nanosized $TiB_2$, SiC, or $Si_3N_4$ particles are added to the infiltrated metal to promote the infiltration of small pores, especially on the surface of the titanium matrix. The use of such particles is effective because they exhibit active contact reactions and wetting by aluminum-containing metal melts. A dense surface of the MMMC is very important in order to avoid an initiation of surface micro-cracks in regard to desired bullet protection applications.

Figure 4:
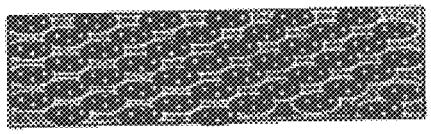
FIG. 4: Sintered structure of the macrocomposite with a layer of the inserts projections placed over the spaces between the inserts of any underside layer.
Figure 7:
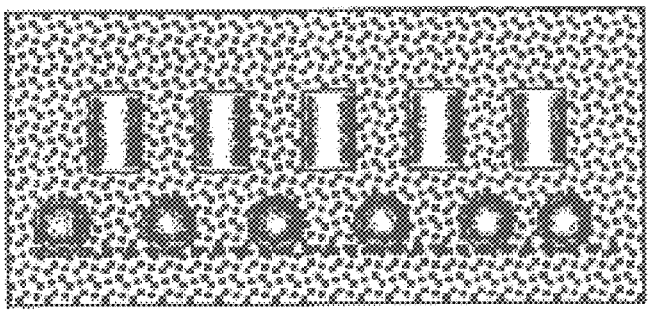
FIG. 7: Examples of controlled macrostructures of bulletproof composite materials
Figure 7:
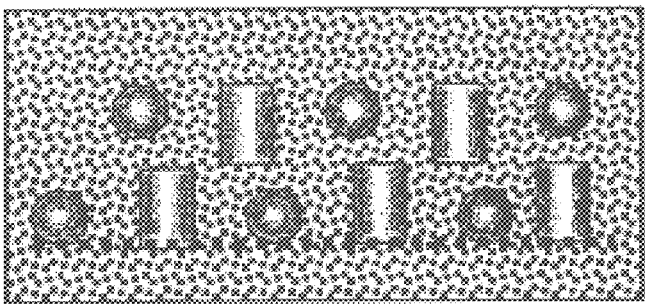
Figure 7:
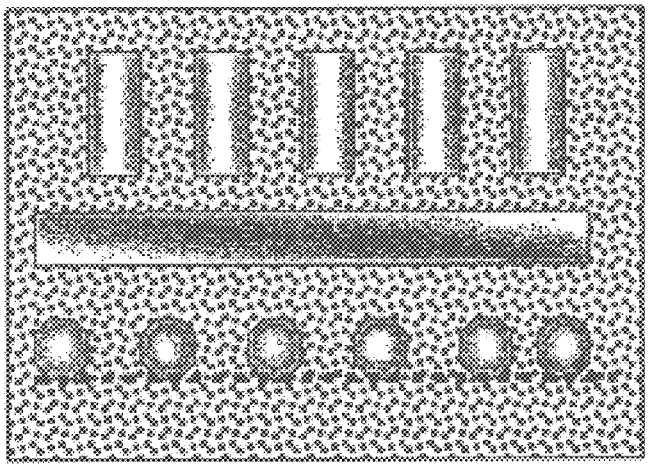

The design of the innovative material is directed to enhance bulletproof properties of the MMMC. First of all, a normal projection area of each ceramic insert is equal or larger than the cross-section area of a bullet or a grenade splinter. Secondly, we propose double-layer and multi-layer composites where the second layer of insert projection is placed over the spaces between the first layer inserts. Thus, the entire area of the material is protected from direct bullet penetration, as shown in FIGS. 4 and 7.

Figure 1:
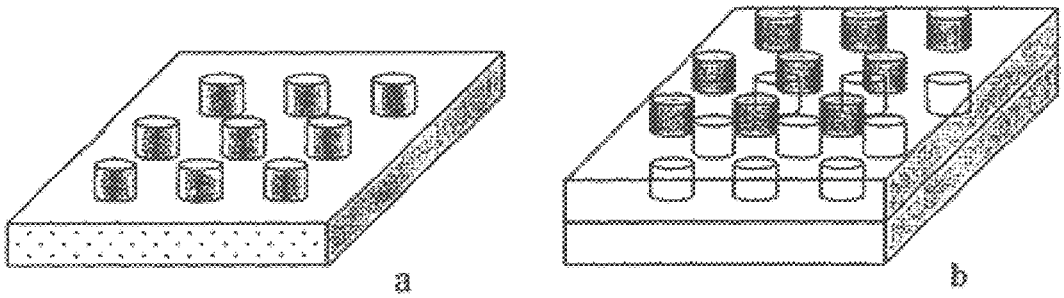
FIG. 1: Ceramic inserts positioned on loose powder (a), then covered with Ti powder, with a new layer of ceramic inserts positioned over (b)
Figure 2:
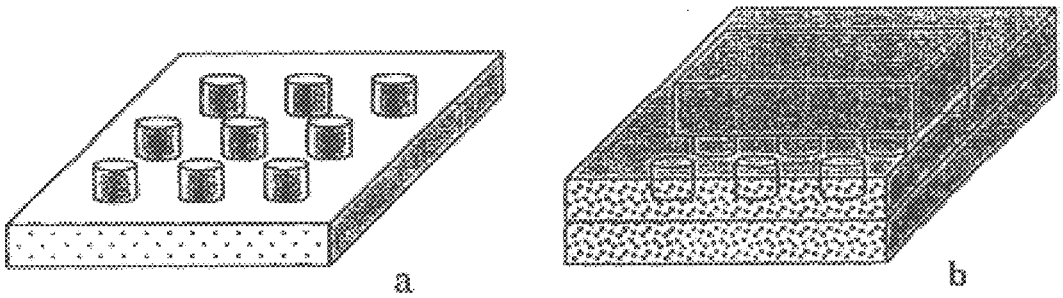
FIG. 2: Ceramic inserts positioned on loose powder (a), then covered with Ti powder, and a ceramic plate positioned over (b)
Figure 3:
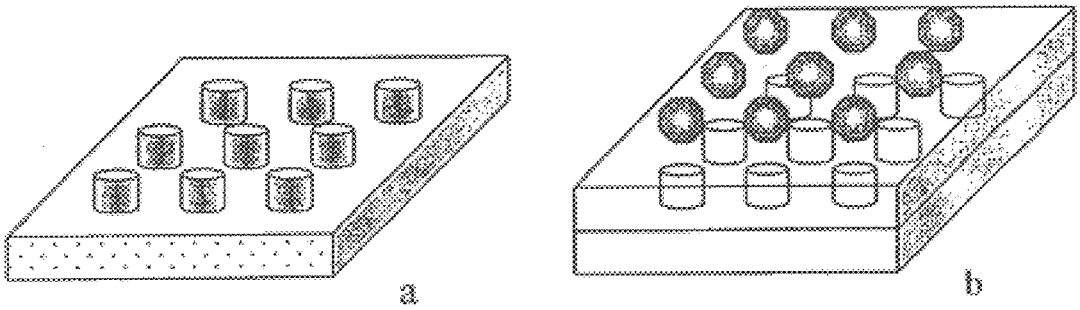
FIG. 3: Ceramic inserts positioned on loose powder (a), then covered with Ti powder, and a new layer of ceramic inserts of different shape positioned over (b)
Figure 5:
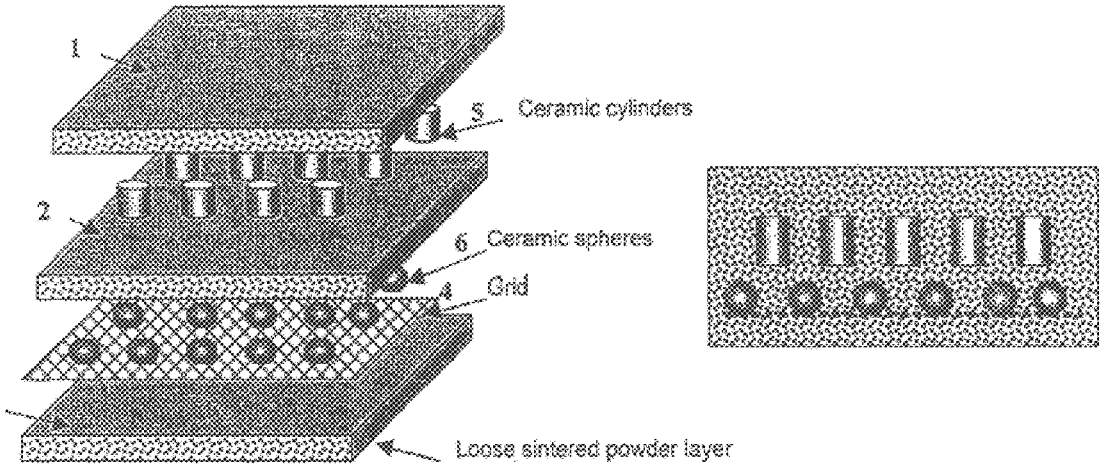
FIG. 5: Sequence of structuring of the composite material (a) with positions of loose powder layers 1, 2, and 3, grid 4, ceramic inserts 5 and 6; and final structure of the macrocomposite (b)
Figure 6:
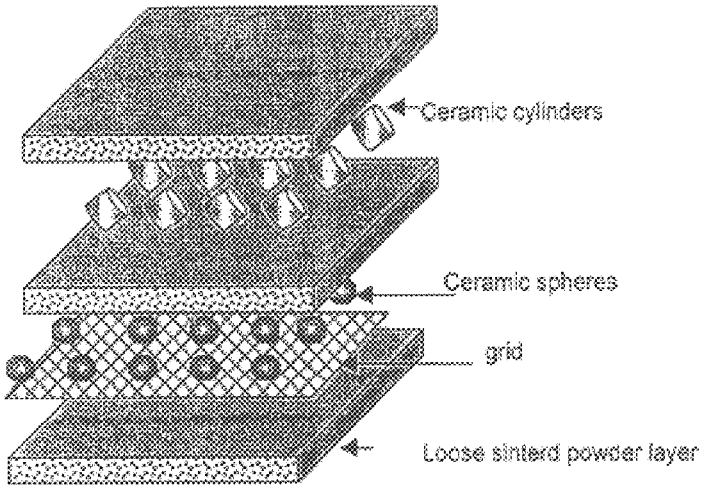
FIG. 6: Version of structuring showed in FIG. 5 with altered positions of ceramic cylinder inserts 5.
Figure 6:
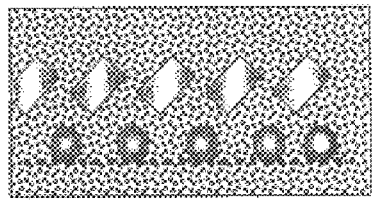

The invented process enables the manufacture of such double-layer and multi-layer composites in one technological cycle. The ceramic inserts of an initial layer are positioned into loose titanium powder, using a titanium grid to aid in placing inserts in a predetermined geometrical order (see FIGS. 1–3). Then, the grid is fixed, the gaps between the inserts are filled with titanium powder, the inserts are covered with same powder, and a new layer of the inserts is positioned onto the first layer and is also covered with titanium powder. Now, this structure is loose sintered into the skeleton preform and infiltrated with Al-Mg melt. The grid is incorporated in the sintered and infiltrated preform, as shown in FIGS. 5 and 6.

Hot isostatic pressing after infiltration is carried out at 500–550° C. and 10–20 ksi to heal a residual porosity (especially in surface zones) and to transform the matrix microstructure into the texture strengthened by intermetallic phases. An absence of pores is important for such sort of composite materials because any single pore can become a start point of cracks when the bullet impact occurs.

Re-sintering or diffusion annealing of the infiltrated preform is the final step for structure control. This procedure forms additional strengthening intermetallics in the matrix, fixes the final grain size and size of dispersed phases, and releases residual stresses after HIP. This treatment can be also used to enlarge the grain size and size of dispersed phases, if necessary.

So, the innovative technology provides control of the MMMC structure at all stages of the manufacturing process—starting with the placement of inserts in a regular pattern into the loose powder and the loose sintering of the matrix. The controlled structure of the lightweight MMMC not only results in the significant improvement of its mechanical and working characteristics, but also makes it possible to manufacture composite article with predictable properties containing high levels of statistical reproductivity.

EXAMPLE 1

The C.P. titanium powder having a particle size of −100 mesh was placed in a flat graphite mold to form a layer measuring 6"×12"×0.25". Alumina cylinders (0.5" diameter, 0.25" height) were placed on loose titanium powder in the order showed in FIG. 1*a* using a titanium grid. The grid and alumina inserts were covered with the additional titanium powder to fill the spaces between cylinders and to form first composite layer. Next alumina inserts were positioned over the gaps between inserts of the first layer, and covered with titanium powder again to form the second composite layer. Then, both layers were loose sintered together at 1100° C. to obtain a skeletal structure having a density of ~35%. The infiltrating alloy having the composition of Mg-10 wt. % Al was placed on the top surface and heated in vacuum to 700° C. to infiltrate said titanium/ceramic skeletal structure. The infiltrated plate was treated by hot isostatic pressing at 550° C. and 15 ksi, and then was annealed for 4 h at 400° C. in vacuum to promote the formation of strengthening intermetallic phases in the titanium matrix. The surface of the resulting composite plate was dense, flat, and smooth.

Specimens 3"×0.5"×0.75" were cut out from the edge and central parts the resulting composite plate to measure hardness and impact strength (see Table). The study of microstructure showed dense structure of the matrix with the presence of dispersed aluminides.

The particle size of titanium powder, sizes of initial powdered preforms, loose sintering temperature, and sizes of specimens for mechanical testing were same in all examples described below.

EXAMPLE 2

The same skeletal structure as in Example 1 was manufactured using alumina spheres of 0.25" dia. for the first layer and the same alumina cylinders for the second layer. The titanium grid was not removed from the first layer and was integrated into the macrocomposite structure as showed in FIGS. 5 and 6. The obtained preform was infiltrated with Mg-50 wt. % Al alloy melt at 700° C. The infiltrated composite plate was HIPed and annealed for 4 h at 400° C. The rigidity of the composite material was increased by the presence of the metal grid in it, therefore, the specimen was not completely broken in the impact testing. The value of impact strength showed in the Table is related to a crack occurrence in the specimen.

EXAMPLE 3

The same skeletal structure as in Example 1 was manufactured using the same procedure, but the infiltrating Mg-10 wt. % Al alloy was placed on top surface of the preform in a quantity insufficient for full infiltration of the porous preform. This results in local thorough porosity of the macrocomposite plate. The impact strength of the specimen was decreased, but the resulting material having local areas permeable for air, may be useful in the design of products such as bulletproof vests.

EXAMPLE 4

The same skeletal structure as in Example 1 was manufactured using the same procedure. A titanium sheet 0.25" thick having several 10 mm holes was placed between the insert layers as showed in FIG. 7*c*. The stiffness of the composite material was significantly increased by the presence of this metal sheet, therefore, the specimen was not completely broken in the impact testing. The value of impact strength showed in the Table is related to a cracks occurrance in the specimen.

EXAMPLE 5

The same skeletal structure as in Example 1 was manufactured using the same procedure but the powder of Ti-6Al-4V alloy was used instead of C.P. titanium to form the composite matrix. The resulting preform was infiltrated with Mg-50 wt. % Al alloy melt at 700° C. The infiltrated composite plate was HIPed and annealed for 4 h at 400° C. The increased strength of the matrix resulted in the increased impact strength of the macrocomposite plate.

EXAMPLE 6

The same skeletal structure as in Example 5 was manufactured using the same procedure, but the powder mixture containing 50 wt. % of Ti-6Al-4V alloy and 50 wt. % of TiAl alloy was used instead of Ti-6Al-4V alloy to form the composite matrix. The impact strength of the macrocomposite plate was not improved but the hardness of the composite increased significantly, which is important for bulletproof material. Besides, the use of TiAl resulted in the weight reduction of the composite as compared to Examples 1–5.

EXAMPLE 7

The C.P. titanium powder was loose sintered in the flat preform having a density of ~35%. The sintered preform was cold rolled to average a density of 66% with the porosity of ~32% near the surface. The pores had a flattened shape with the long axis parallel to the direction of rolling. Then, two layers of alumina inserts covered with titanium powder were manufactured, infiltrated with alloy containing Al 33, Nb 2, Si 1 wt. %, and Mg as the balance, sintered and annealed as described in Example 1. The improved microstructure of the matrix with the presence of dispersed aluminides and silicides resulted in increased impact strength of the macrocomposite as compared to Example 1.

EXAMPLE 8

Curved vest armor is being made as follows. A concave shaped graphite bottom plate is filled with one layer of Ti-6Al-4V powder. A curved shape of the powder layer is achieved by moving a steel blade over a special profile curvature machined on the graphite plate. A curved Ti wire mesh is manufactured by cutting titanium wire to a particular length and squeezing it between two walls holding the first layer of the powder (a curvature radius is a strait function between the length of the walls and the length of the wire mesh). The procedure of positioning ceramic inserts, sintering and infiltrating single-layer or multilayer preforms is carried out according to Example 1.

COMPARATIVE EXAMPLE

The C.P. titanium plate 6"×6"×1" was machined to accommodate a ceramic alumina plate 4"×4"×0.5". Said ceramic plate was placed into the machined cavity, covered with another titanium plate 6"×6"×0.5", welded, and HIPed at 800° C. and 15 ksi. The microstructure of the composite showed that alumina plate had multiple microcracks.

Mechanical properties of lightweight metal matrix macrocomposites

| Example | Metal powder | Inserts | Infiltrated Alloy | Hardness, HRc (matrix) | Impact strength ft lb |
|---|---|---|---|---|---|
| 1 | CP Ti | Alumina | Mg-10 Al | 32–34 | 16.3 |
| 2 | CP Ti | Alumina | Mg-50 Al | 32–34 | 17.8 |
| 3 | CP Ti | Alumina | Mg-10 Al | 32–34 | 10.6 |
| 4 | CP Ti | Alumina | Mg-10 Al | 32–34 | 19.4 |
| 5 | Ti-6 Al-4 V | Alumina | Mg-50 Al | 35–37 | 20.8 |
| 6 | Ti-6 Al-4 V + 50% TiAl | Alumina | Mg-50 Al | 41–43 | 21.1 |
| 7 | CP Ti | Alumina | Mg-33 Al-2 Nb-1 Si | 34–35 | 18.2 |

We claim:

1. The lightweight bulletproof metal matrix macrocomposites containing (a) 10–99 vol. % of permeable skeletal structure of titanium, titanium aluminide, titanium-based alloys, and/or mixtures thereof infiltrated with low-melting metal selected from aluminum, magnesium, aluminum-based alloys, and/or magnesium-based alloys, and (b) 1–90 vol. % of ceramic and/or metal inserts positioned within said skeleton, whereby a normal projection area of each inserts is equal to or larger than the cross-section area of a bullet or a projectile body.

2. The lightweight bulletproof metal matrix macrocomposites according to claim 1, wherein inserts are manufactured from the ceramic material selected from the group consisting of oxides, borides, aluminides, carbides, and nitrides, such as alumina, zirconia, yttria stabilized zirconia, silicon carbide, silicon nitride, boron carbide, titanium carbide, cemented carbides, and/or other ceramics or cermets.

3. The lightweight bulletproof metal matrix macrocomposites according to claim 1, wherein inserts are manufactured from the metals selected from the group consisting of titanium, beryllium, aluminum, magnesium, and alloys containing these metals, and/or steels.

4. The lightweight bulletproof metal matrix macrocomposites according to claim 1 or 2, wherein inserts are manufactured from the ceramics reinforced with metal particles and/or fibers.

5. The lightweight bulletproof metal matrix macrocomposites according to claim 1 are manufactured as flat or solid shaped, double-layer, or multi-layer articles containing the same inserts or different inserts in each layer, whereby insert projections of each layer cover spaces between inserts of the underlying layer.

6. The lightweight bulletproof metal matrix macrocomposites according to claim 1, wherein the infiltrated metal contains 1–70 wt. % of aluminum and magnesium as the balance.

7. The lightweight bulletproof metal matrix macrocomposites according to claim 6, wherein the infiltrated metal, contains aluminum 1–70 wt. %, at least one metal selected from the group of titanium, silicon, zirconium, niobium, and/or vanadium 1–4wt. %, and magnesium as the balance.

8. The lightweight bulletproof metal matrix macrocomposites according to claim 6 or 7, wherein the infiltrated metal additionally contains 0–3 wt. % of at least one dispersed powder selected from $TiB_2$, SiC, and $Si_3N_4$ having a particle size of 0.5 $\mu$m or less, to promote infiltrating and wetting by Al-containing alloys.

9. The lightweight bulletproof metal matrix macrocomposites according to claim 1, wherein articles manufactured from said macrocomposites have local porous areas permeable for air.

10. The manufacture of lightweight bulletproof metal matrix macrocomposites according to claim 1 includes the steps of:

(a) forming the permeable metal powder and inserts into the skeleton-structured preform by positioning inserts in. the powder followed by loose sintering in vacuum, or die pressing, and/or cold isostatic pressing followed by sintering in vacuum or low-pressure sintering in an inert gas, or combinations thereof to provide the average porosity of 20–70%, (b) heating the obtained porous preform with inserts and infiltrating metal in vacuum or in an inert gas atmosphere up to the infiltration temperature, (c) infiltrating the porous preform with molten infiltrating metal for 10–40 min at 450–750° C., (d) hot isostatic pressing of the infiltrated composite to. heal possible porosity and transform the matrix into the textured microstructure strengthened by intermetallic phases, (e) re-sintering or diffusion annealing.

11. The manufacture according to claim 10 includes positioning inserts in Ti-base powder or onto loose sintered plate by using a metal grid aiding the placement of the inserts in a predetermined geometrical pattern, filling the gaps between the inserts with a metal powder, and removing the grid.

12. The manufacture according to claim 10 includes positioning of the ceramic inserts in Ti-based powder or onto loose sintered plate by using a metal grid aiding the placement of the inserts in a predetermined geometrical pattern, affixing the grid, filling the gaps between the inserts and the grid with a metal powder, and then, positioning a new layer of inserts onto the first layer with the aid of another metal grid, so that the second layer of inserts projections is placed over the space. between the inserts of the first layer, whereby this procedure may be repeated until the desired number of layers is structured into the preform to be infiltrated and sintered with all components including the grids, which become the integral part of the macrocomposite material.

13. The manufacture according to claim 10 or 12, wherein said inserts have any practical geometrical shape: balls, cylinders, cubes, plated polygons.

14. The manufacture according to claim 10 or 12, wherein said layers of the macrocomposire preform contain inserts having different geometrical shape.

15. The manufacture according to claim 10, wherein the infiltration of porous preform is carried out spontaneously in vacuum, by a pressure gradient, hot isostatic pressing, hot pressing, or under low pressure of an inert gas.

16. The manufacture according to claim 10, wherein a primary metal powder forming said skeletal structure of the macrocomposite preform is selected from Ti-6Al-4V alloy powder, titanium aluminide powder, or a mixture thereof.

* * * * *